US011885506B2

(12) United States Patent
Bianchi et al.

(10) Patent No.: US 11,885,506 B2
(45) Date of Patent: Jan. 30, 2024

(54) AIR CONVECTION SMART DIFFUSION SYSTEM

(71) Applicant: WHIRLPOOL CORPORATION, Benton Harbor, MI (US)

(72) Inventors: Fabio Bianchi, Benton Harbor, MI (US); Mauro Baldazzi, Melegnano (IT); Laura Fossati, Travedona Monate (IT)

(73) Assignee: Whirlpool Corporation, Benton Harbor, MI (US)

( * ) Notice: Subject to any disclaimer, the term of this patent is extended or adjusted under 35 U.S.C. 154(b) by 512 days.

(21) Appl. No.: 17/107,053

(22) Filed: Nov. 30, 2020

(65) Prior Publication Data

US 2022/0170646 A1 Jun. 2, 2022

(51) Int. Cl.
*F24C 15/32* (2006.01)
*F24C 15/16* (2006.01)

(52) U.S. Cl.
CPC ..... *F24C 15/322* (2013.01); *F24C 15/16* (2013.01)

(58) Field of Classification Search
CPC ..... F24C 15/322; F24C 15/16–168; F24C 15/32–327; A47J 37/0641; A47J 37/0664; A47J 37/0694
USPC ..... 126/332, 337 R, 338, 337 A; 454/56, 58, 454/61–67, 175, 177, 193
See application file for complete search history.

(56) References Cited

U.S. PATENT DOCUMENTS

| | | | | |
|---|---|---|---|---|
| 7,183,520 | B2 | 2/2007 | Park | |
| 7,735,481 | B1 * | 6/2010 | Kalsi | F24C 15/16 126/339 |
| 7,836,874 | B2 | 11/2010 | McFadden | |
| 8,991,383 | B2 | 3/2015 | Johnson | |
| 10,337,745 | B2 | 7/2019 | McKee et al. | |
| 2006/0240761 | A1 * | 10/2006 | Yamaguchi | A47F 3/001 454/184 |
| 2006/0289435 | A1 * | 12/2006 | Park | H05B 6/6426 219/394 |
| 2014/0238383 | A1 * | 8/2014 | Armstrong | F24C 15/16 126/337 A |
| 2016/0010874 | A1 * | 1/2016 | Phillips | F24C 15/006 126/198 |

FOREIGN PATENT DOCUMENTS

| | | | |
|---|---|---|---|
| CN | 109381043 | A | 2/2019 |
| DE | 69315668 | T2 | 4/1998 |
| EP | 2469175 | B1 | 2/2018 |
| JP | 56334427 | A | 2/1988 |
| JP | S6428711 | U | 2/1989 |

* cited by examiner

*Primary Examiner* — Helena Kosanovic
*Assistant Examiner* — Thao Uyen Tran-Le
(74) *Attorney, Agent, or Firm* — Brooks Kushman, P.C.

(57) ABSTRACT

A cooking appliance may include an oven cavity having a cavity top, a cavity back, and cavity side walls, an interior side wall extending parallel to each of the cavity side walls defining a passage therebetween, and a plurality of side rails extending along the interior side walls, the rails being rotatable between a rest position in which no oven rack is installed and airflow is blocked, and an active position in which the oven rack is installed and airflow is provided.

16 Claims, 8 Drawing Sheets

AIR CONVECTION SMART DIFFUSION SYSTEM

TECHNICAL FIELD

Disclosed herein are air convection smart diffusion systems.

BACKGROUND

Cooking appliances, such as convection ovens, often have adjustable racks, allowing the user to change the location and relative height of a rack within the oven cavity. The racks are configured to support cooking articles and/or food items thereon, for example, to allow for positioning of the articles and/or items within the appliance during cooking. The racks are repositionable to provide the desired positioning relative to operative elements (such as burners or the like. Some racks are slidably supported to be extendable partially out of the appliance cavity for easier insertion and removal of the related cooking articles and food items. Some racks are completely removable and storable outside of the oven cavity. However, distribution of convection air may not be efficiently used in some oven systems.

SUMMARY

A cooking appliance may include an oven cavity having a cavity top, a cavity back, and cavity side walls, an interior side wall extending parallel to each of the cavity side walls defining a passage therebetween, and a plurality of side rails extending along the interior side walls, the rails being rotatable between a rest position in which no oven rack is installed and airflow is blocked, and an active position in which the oven rack is installed and airflow is provided.

A convection oven having variable air flow patterns depending on rack placement therein may include an oven cavity having a cavity top, a cavity back, and cavity side walls, and a plurality of side rails extending along the cavity side walls, the rails being movable between a rest position in which no oven rack is installed and airflow is blocked, and an active position in which the oven rack is installed and airflow is provided, wherein each of the side walls define a set of air passages corresponding to each side rail and configured to provide convection air to the rack arranged on the respective side rail.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Disclosed herein is a rack system of a cooking appliance such as a convection oven. The cooking appliance allows for customizable convection air flow automatically based on the placement of the racks therein. Upon placement of a rack, a grate may open air passages within the side of the appliance, allowing convection air to flow therefrom onto the rack. The rack is configured to hold cooking items such as food, during cooking. The rails are movable between an active position in which a rack is arranged thereon, and a rest position, where the rack is not installed thereon. In the rest position, the rails may be biased to be generally upright against the side walls of the oven.

A lever may be arranged within the side walls and attached to the rails. When the rails are in the rest position, the lever is arranged at an angle within the side walls. When the rails are in the active position, e.g., pushed down to hold the rack, the lever is moved to a perpendicular position within the side walls. The air grate may be arranged within the oven walls and may be configured to move with actuation of the lever. In the perpendicular position, the air grate may be in a lowered position, allowing openings in the grate to align with the air passages and allowing hot air to flow to the rack. When no rack is installed, the air grate may be in an elevated position due to the angle of the lever on which it rests. In this state, the air passages are closed off by the air grate, preventing hot air from flowing from the air passages. This may in turn allow all of the hot air to be forced to the racks that are installed and in use and vent the remaining hot air through the walls.

Accordingly, when the rack is inserted into the oven, the rails on either side of the rack rotate downwards to engage the rack. The rails, in turn, actuate a lever that lowers an air grate within the oven side walls. Each rail may have at least one air passage in close proximity. This air passage may be opened and closed by the air grate upon rotation of the rails. Thus, the user automatically adjusts the airflow upon inserting the rack at the desired location within the oven.

Figure 1:
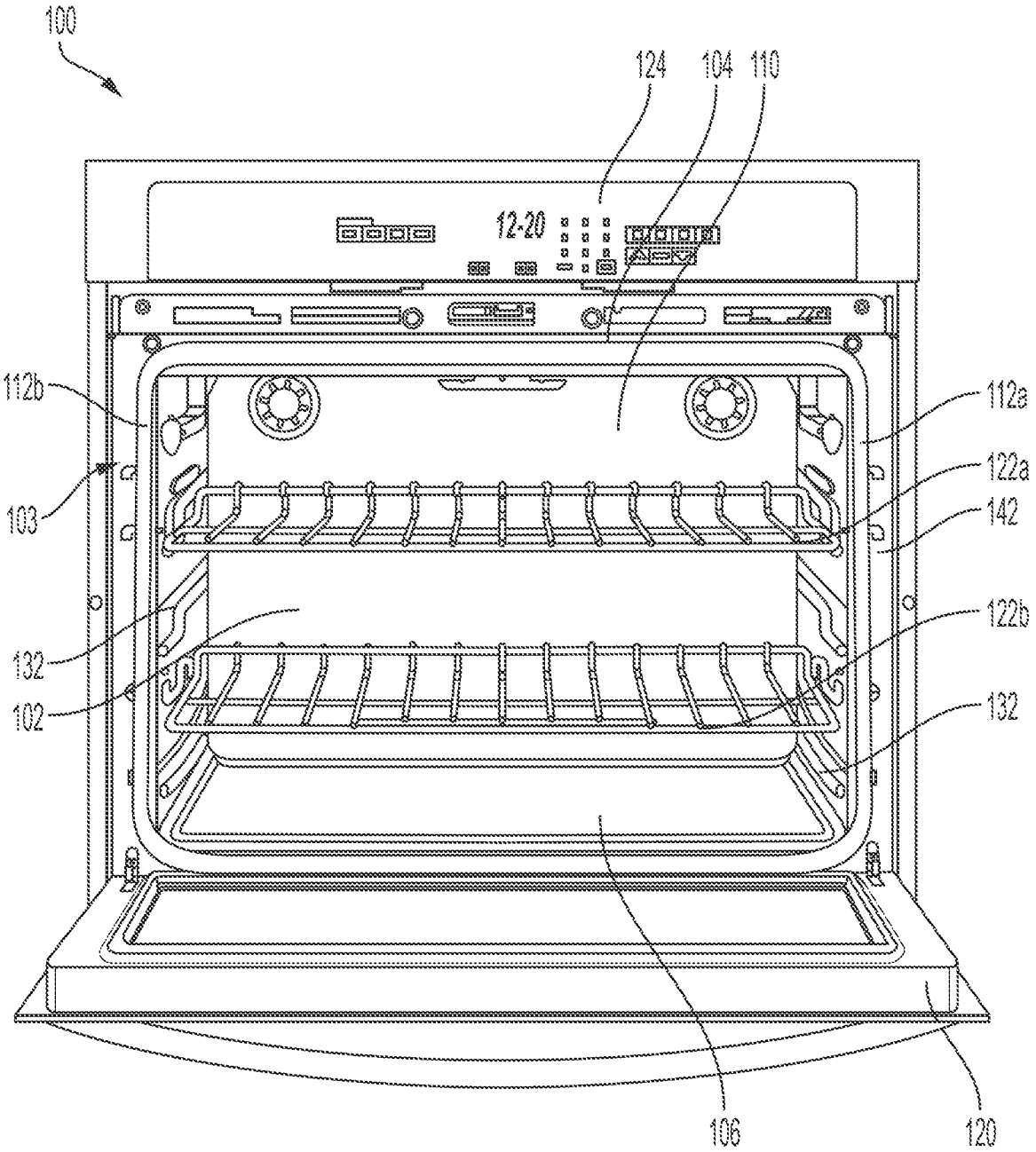
FIG. 1 illustrates an example front perspective view of an oven in accordance with one example embodiment.

FIG. 1 illustrates an example front perspective view of an oven 100 in accordance with one example embodiment. The oven 100 may be any cooking appliance such as a conventional oven, convection oven, conduction oven, microwave oven, toaster oven, as well as function specific ovens such as roaster oven, pizza ovens, etc. The oven 100 may be a standalone oven, a built-in oven, a combination oven and stovetop, etc.

The oven 100 may form a cabinet 103 and define a cavity 102 having a cavity top 104, cavity bottom 106, cavity back 110, a first side wall 112*a* and a second side wall 112*b* (collectively referred to herein as "side walls 112"). A side wall passage 142 may be defined between the side walls 112 and the cabinet 103 to allow heated air to flow therein. A door assembly 120 may be hinged at a front of the cavity bottom 106 to permit access to the cavity 102. The door assembly 120 may include a window and a handle and may hermetically seal the cavity when the door is in a closed position. A door sensor may be arranged on the door or the cavity 102 to detect an open and closed position of the door 120.

The cavity 102 may be configured to receive food items for cooking, baking, and/or broiling during a cooking cycle. The cavity 102 may include a temperature sensor for determining the air temperature within the cavity 102 during cooking. The oven 100 may include a controller configured to receive user inputs at a user interface 124. The user interface 124 may also provide information to the user such as cook time, temperature, etc.

The oven 100 may include a heating system for heating the cavity 102 during cooking. The heating system may include a heating element such as a gas heating element or an electric heating element. The heating element may be arranged between the cabinet 103 and the cavity back 110 and/or the cavity top 104. The heating element may produce heat and the heat may be forced into the cavity 102 via air passages in the cavity walls 112. The heat may then circulate throughout the cavity 102 to heat and cook the food items therein.

The oven 100 may include one or more racks 122 within the cavity 102 for supporting the food items during cooking. As shown by way of example in FIG. 1, the oven may include a top rack 122*a* and a bottom rack 122*b* (collectively referred to herein as racks 122). It should be noted that while two racks 122 are shown, ovens 100 with more or fewer racks 122 are possible. Regardless of quantity, the racks 122 may rest on side rails 132 arranged along the side walls 112. The side rails 132 may extend parallel or generally parallel with the cavity top 104 and cavity bottom 108 along the side walls 112 at spaced intervals. The side rails 132 may extend up the height of the side walls 112 to allow for varying positions of the racks 122 within the cavity 102. For each rail 132 arranged on the first side wall 112*a*, a corresponding rail 132 is arranged on the opposite second side wall 112*b* (generally at the same relative height) so that the rack 122 may be evenly maintained on each side thereof.

Figure 2B:
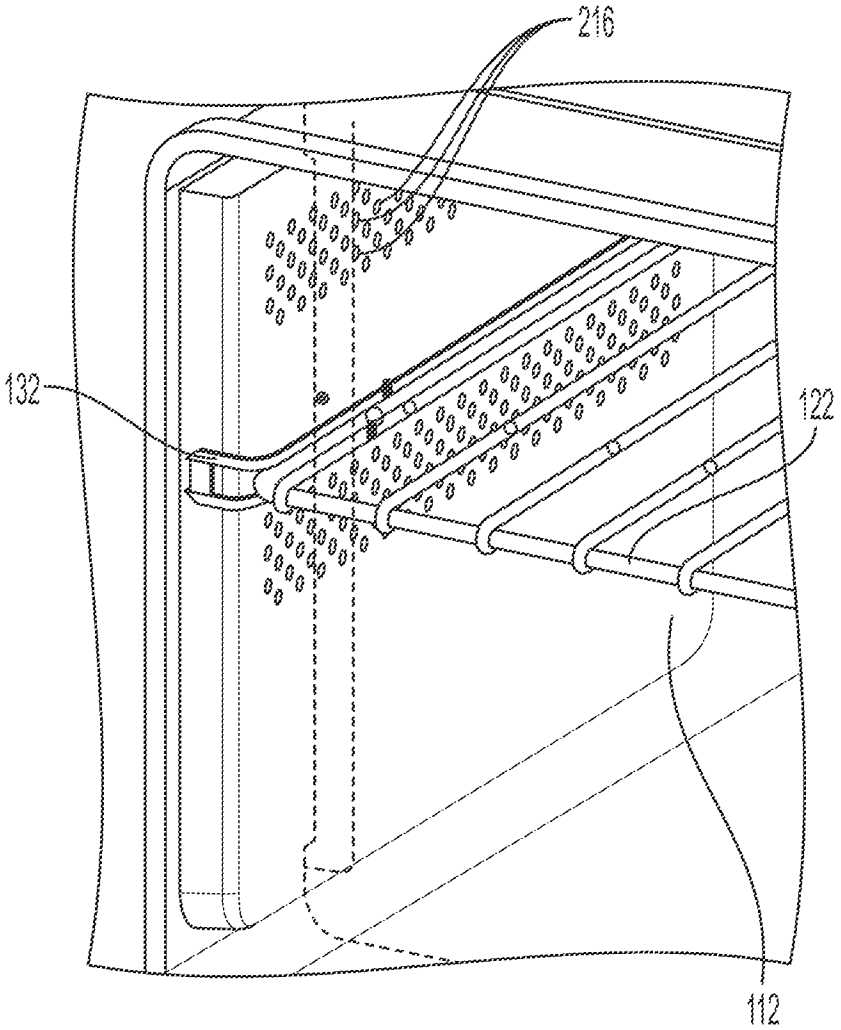
FIG. 2B illustrates a partial perspective view of the oven cavity side wall having side rails in an active position.
Figure 2A:
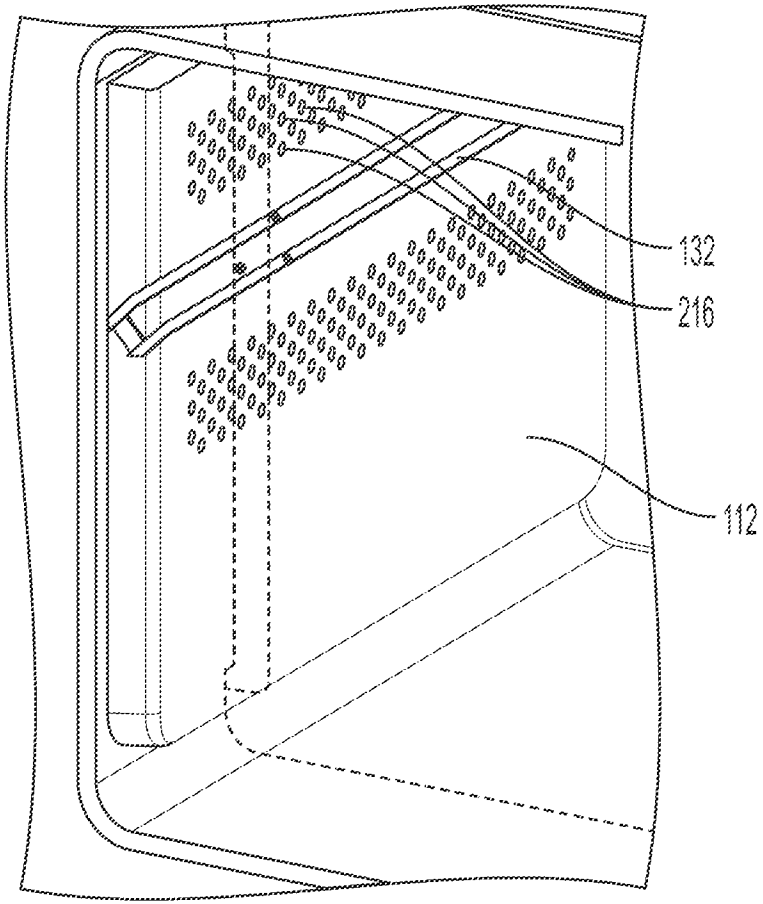
FIG. 2A illustrates a partial perspective view of an oven cavity side wall having side rails in a rest position.
Figure 3B:
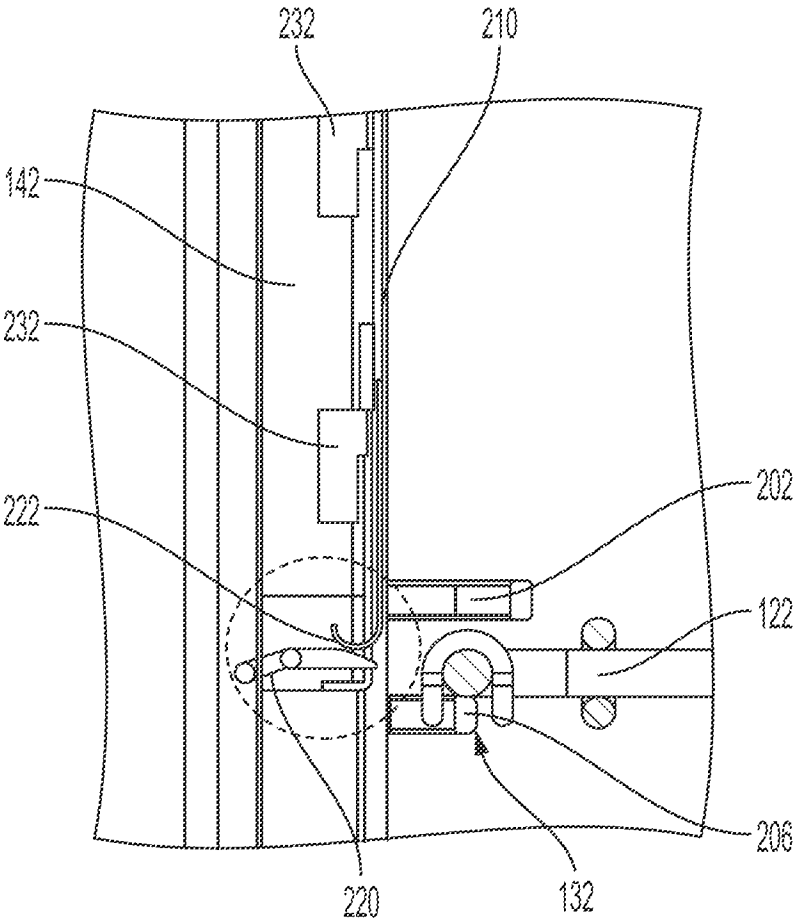
FIG. 3B illustrates a side view of the oven cavity side wall of FIG. 2B.
Figure 3A:
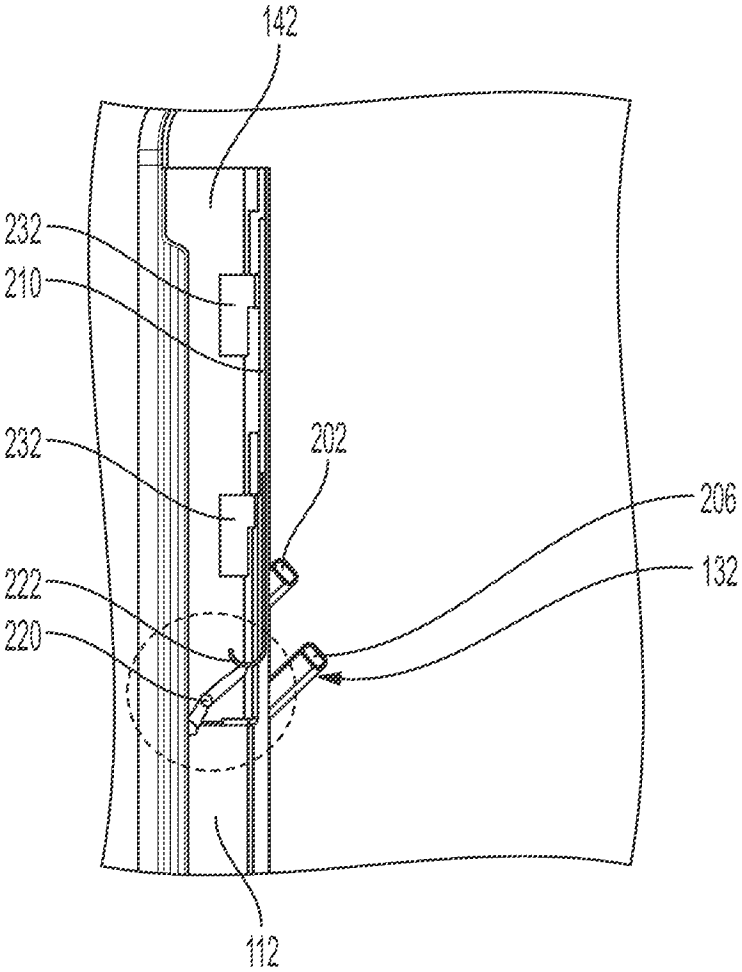
FIG. 3A illustrates a side view of the oven cavity side wall of FIG. 2A.

FIG. 2A illustrates a partial perspective view of an oven cavity side wall 112 having side rails in a rest position. FIG. 2B illustrates a partial perspective view of the oven cavity side wall having side rails in an active position. FIG. 3A illustrates a side view of the oven cavity side wall of FIG. 2A. FIG. 3B illustrates a side view of the oven cavity side wall of FIG. 2B.

Referring to FIGS. 2A and 2B, as well as FIGS. 3A and 3B, the rails 132 may form a C-like profile with parallel upper 202 and lower supports 206 (best shown in FIGS. 3A and 3B). The rails 132 extend the length of the side walls 112 such that the rack 122 is arranged within the upper support 202 and the lower support 206 of the rail 132. The rails 132 may each be movable between a rest position and an active position, but may be biased in the rest position. In the active position, the rails 132 may be perpendicular to the side walls 112 and configured to receive the end of the rack 122 therein, as best illustrated in FIGS. 2B and 3B. In the rest position, the rails 132 may be configured to fold at the side walls so as to not extend into the cavity 102 to the same degree as when in the active position. That is, the rails may be 'folded' and only extend nominally into the cavity, as best illustrated in FIGS. 2A and 3A.

As best shown in FIG. 3B, the rail 132 may rest on the lower support 206 in the active position. In the rest position, as shown in FIG. 3A, the C-shaped rail may be arranged at an angle relative to the side wall 112 such that the rail 132 is stored in an unobtrusive way when not in use. This allows dishes and food items to be loaded into the cavity 102 without abutting the unused rails 132. As the rails 132 fold away in the rest position, any possibility for unused rails 132 to obstruct heat flow within the cavity 104 is eliminated.

Referring back to FIGS. 2A and 2B, the side wall 112 may define a plurality of air passages 216 or wall openings configured to allow heated air to pass from the side wall passages into the cavity 102. The heat may heat the cavity 102 to a temperature determined by the controller and received from the user interface 126. For example, if a convection function is activated, the controller may adjust the oven temperature lower than might otherwise be used for a non-convention mode of the oven. Each rail 132 may have a corresponding group of air passages 216 associated therewith. That is, a set or group of passages 216 may direct hot air to the rack 122 associated with the rail 132 adjacent to the passages 216.

Figure 4B:
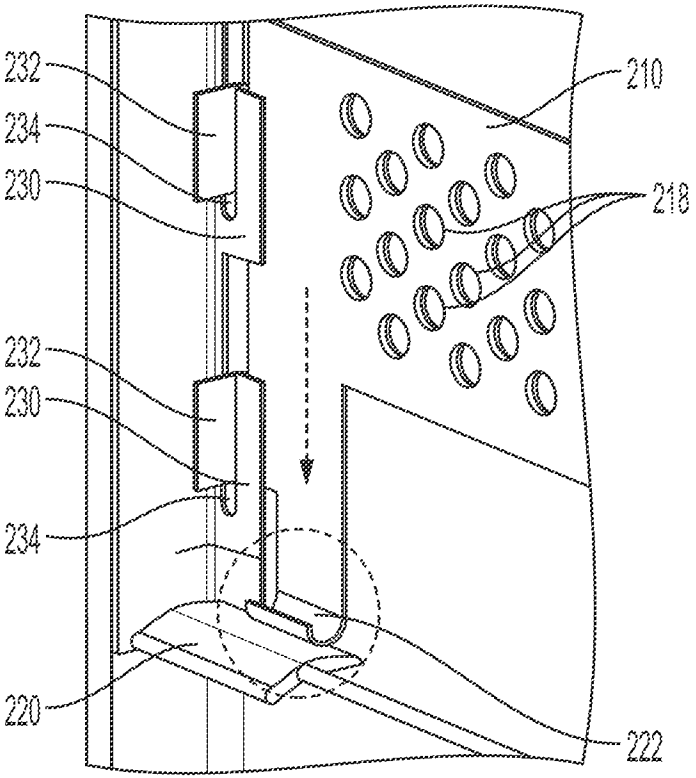
FIG. 4B illustrates a perspective rear view of the oven cavity side wall of FIG. 2B.
Figure 4A:
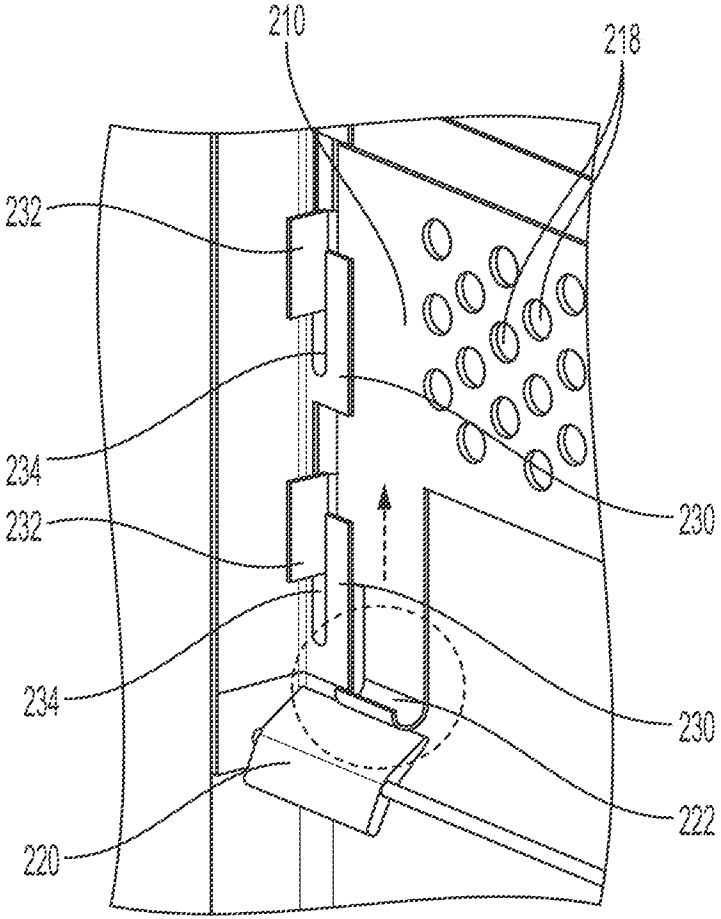
FIG. 4A illustrates a perspective rear view of the oven cavity side wall of FIG. 2A.

FIG. 4A illustrates a perspective rear view of the oven cavity side wall of FIG. 2A. FIG. 4B illustrates a perspective rear view of the oven cavity side wall of FIG. 2B. As best shown in FIGS. 3A and 4A, an air grate 210 may be arranged between the oven cabinet 103 and the side walls 112. The air grate 210 may be configured to move between the active position and the rest position with the respective rail. This may be achieved, in the illustrated example, by a lever 220 arranged below the grate 210. The lever 220 may be fixed to a portion of the rail 132 in that as the rail 132 is rotated, the lever 220 is actuated. A proximal end of the lever 220 may be attached to one of the upper or lower supports 202, 206 of the rail 132 so that it moves with the rail 132.

The lever 220 may pivot between the active position and the rest position with the respective rail 132. In the active position, as best illustrated in FIGS. 3B and 4B, the lever 220 may be generally perpendicular to the side wall 112, similar to the rail 132. In the rest position, as best illustrated in FIGS. 3A and 4A, the lever 220 may be arranged at an angle relative to the side wall 112, similar to the rail 132. The lever 220 may abut a lip end 222 of the grate 210. Upon actuation at the lever 220, the lip end 222 may move with the lever 220. In turn, the vertical placement of the grate 210 is adjusted.

The lip end 222 may be a curved flange configured to rest on the lever 220. As explained, upon actuation of the lever 220, the lip end 222 and thus the air grate 210 may move vertically. The curved portion may allow for easy, less frictional engagement with the lever 220 such that the curve may allow for various portions of the lip end 222 to engage with the lever 220 as the height of the lever 220 changes.

The grate 210 defines a plurality of openings 218 configured to align with the air passages 216 of the side walls 112 in the active position. In the rest position, the openings 218 are misaligned and closed with respect to the air passages 216. Thus, in the rest position the solid portions of the grate 210 block the air passages 216 of the side wall 112, preventing hot air from leaving the side wall at the respective air passages 216. The grate 210, via the actuation and placement of the lever 220, slides or otherwise moves vertically within the side wall passage to selectively allow or block air from leaving through the passages 142 of the side wall 112.

As best shown in FIGS. 4A and 4B, the side walls 112 may define at least one grate support 230 configured to maintain the grate 210 therein. In these examples, two grate supports 230 are illustrated, though more or fewer grate supports 230 may be utilized. The grate support 230 may define at least one channel 234 or slot configured to receive an end projection 232 of the grate 210. The end projection 232 may extend from an end of the grate 210 at one or both of the front of the grate 210 and the back of the grate 210. The end projection 232 may be a tab extending perpendicular to the grate 210. The channel 234 may receive the end projection 232 to aid in maintaining the grate 210 upright and vertical within the side wall passage 142. However, the end projection 232 and channel 234 arrangement may also act as a guide to allow for controlled vertical movement therein, while still supporting and maintaining the grate 210.

For example, in the active position, such as that shown in FIG. 4B, the end projection 232 may be mostly, if not completely, seated within the channel 234. This may be because the lever 220 is perpendicular to the side wall 112, thus causing the gate to be in the lower, active position. In this position, the openings 218 of the grate 210 align with the air passages 216 of the side walls 112, thus allowing hot air to pass into the cavity 102 therefrom.

In the rest position, such as that shown in FIG. 4A, the end projections 232 may be at least partially seated within the channel 234. This may be because the lever 220 becomes rotated, causing the end projections 232 to be turned upward at an angle, thereby pushing the grate 210 upward into an elevated position, lifting the end projection 232 within the channel 234.

During use, when a rack 122 is arranged within one of the rails 132, the weight of the rack 122 causes the rail 132 to become perpendicular with the side wall 112. The rail 132 then causes the lever 220 to actuate into a similar perpendicular arrangement, whereby the lever 220 allows the lip end 222 to drop, lowering the vertical placement of the openings 218 within the grate 210. This lower positioning aligns the openings 218 with the air passages 216 and allows hot air to pass into the cavity at the air passages 216. Thus, when the rack 122 is installed, the air passages 216 associated with the rail 132 upon which the rack 122 is placed are automatically opened, allowing hot air to flow directly onto the rack 122, warming food items thereon.

Figure 5A:
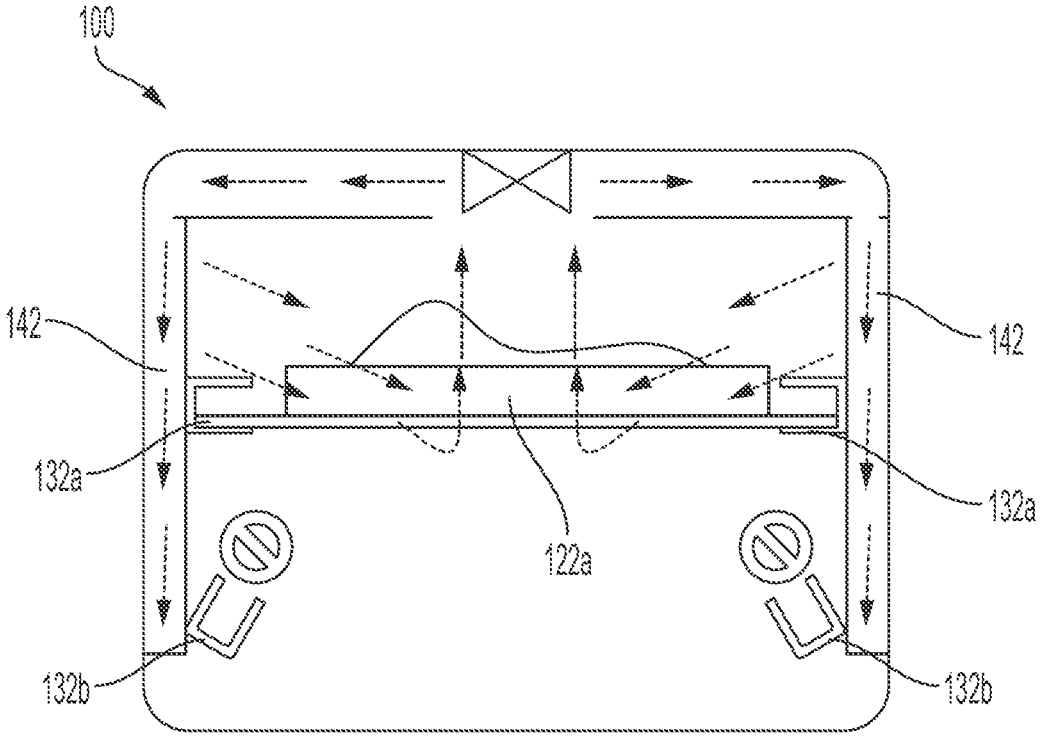
FIG. 5A illustrates an air flow schematic view of the oven with a top rack.

FIG. 5A illustrates an air flow schematic view of the oven with a top rack. In this example, the top rack 122*a* is installed in a first set of rails 132*a*. As illustrated, the rails 132*a* are in the active position. A second set of rails 132*b* are in the rest position since no rack is installed thereat. The air flow is illustrated by the arrows. Because the first set of rails 132*a* are in the active position, the grate 210 is automatically lowered via the lever 220 mechanism to allow the openings 218 of the grate to align with the air passages 216 of the side walls 112. Therefore, hot air is directed onto the top rack 122*a*. However, because the lower second set of rails 132*b* are not in the active state, the air passages 216 associated therewith are closed by the grate 210 and therefore do not allow hot air to flow.

Figure 5B:
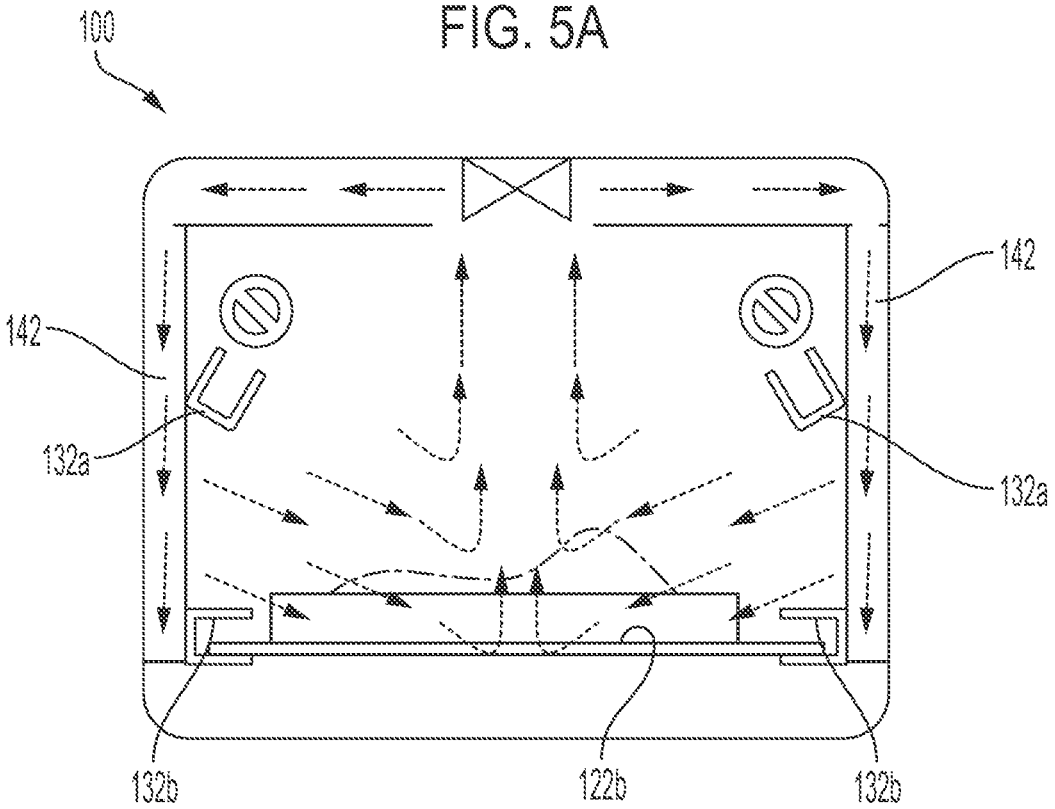
FIG. 5B illustrates an air flow schematic view of the oven with a bottom rack.

FIG. 5B illustrates an air flow schematic view of the oven 100 with a bottom rack 122*b*. In this example, the top rack 122*a* is not installed at the first set of rails 132*a*, but the bottom rack 122*b* is installed at the second set of rails 132*b*. As illustrated, the second set of rails 132*b* are in the active position. The first set of rails 132*a* are in the rest position since no rack is installed thereat. The air flow is illustrated by the arrows. Because the second set of rails 132*b* are in the active position, the grate 210 is automatically lowered via the lever 220 mechanism to allow the openings 218 of the grate to align with the air passages 216 of the side walls 112. Therefore, hot air is directed onto the bottom rack 122*b*. However, because the first set of rails 132*a* are not in the active state, the air passages 216 associated therewith are closed by the grate 210 and therefore do now allow hot air to flow to the area by the first set of rails 132*a*.

Figure 5C:
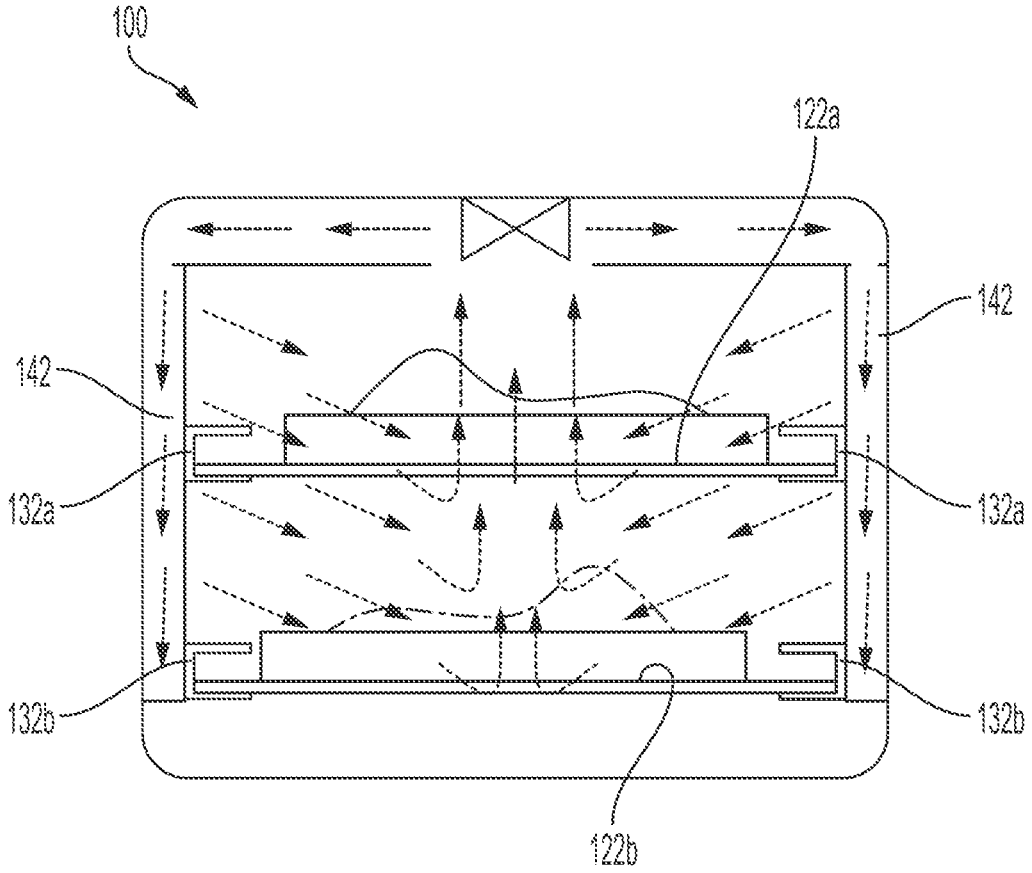
FIG. 5C illustrates an air flow schematic view of the oven with top and bottom racks.

FIG. 5C illustrates an air flow schematic view of the oven with top and bottom racks 122. In this example, the top rack 122*a*, as well as the bottom rack 122*b* are both installed and both rails 132*a*, 132*b* are in the active position. The air flow is illustrated by the arrows. Because the first and second set of rails 132*a*, 132*b* are in the active position, the grate 210 is automatically lowered via the lever 220 mechanism to allow the openings 218 of the grate to align with the air passages 216 of the side walls 112 for each rack 122. Therefore, hot air is directed onto both of the racks 122.

Figure 6B:
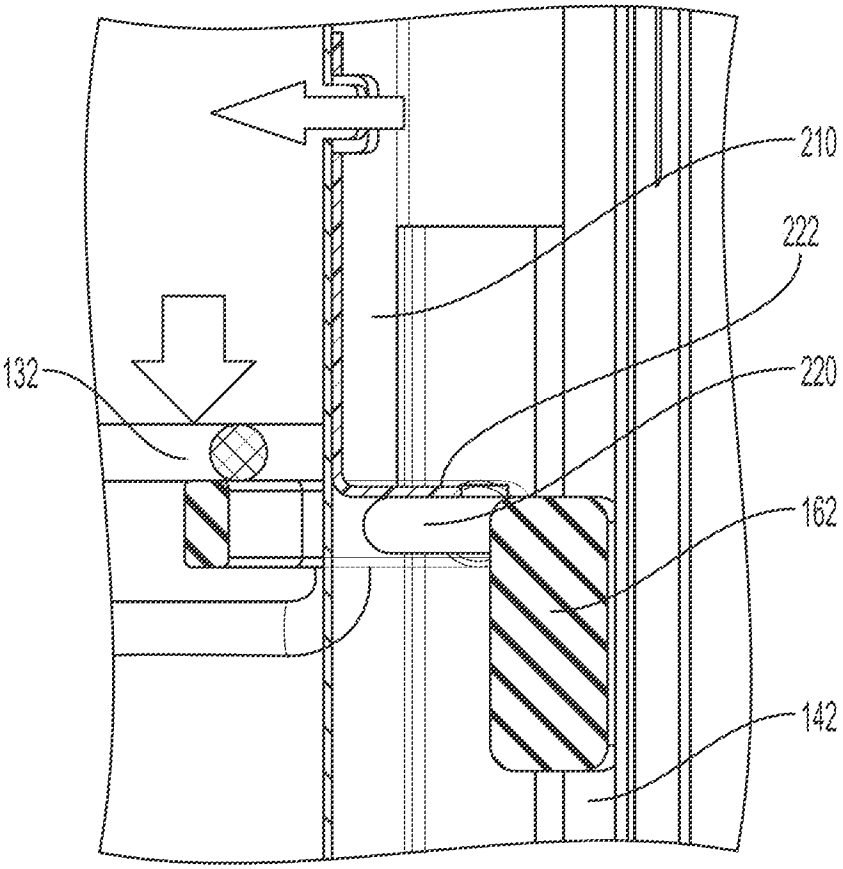
FIG. 6B illustrates a side view of the side wall passage with the rail in the rest position.
Figure 6A:
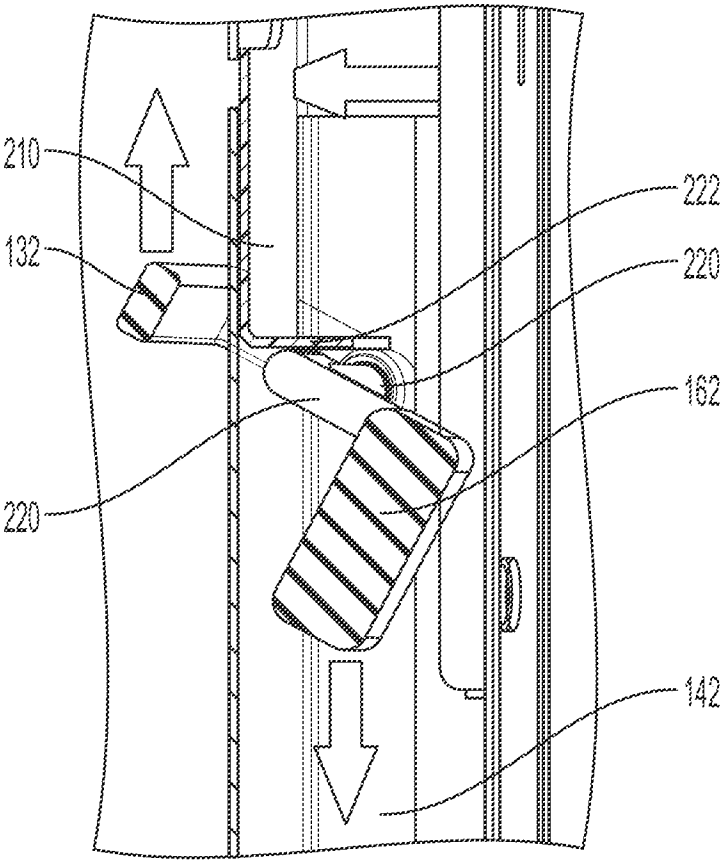
FIG. 6A illustrates a side view of the side wall passage with the rail in the active position.

FIG. 6A illustrates a side view of the side wall passage 142 with the rail 132 in the rest position. The side wall passage 142 may include a weight 162 configured to attach to the rail 132. In the rest position where the rail 132 (now shown in FIG. 6A) is not in use, the weight 162 may weigh down the opposite side of the rail 132 within the side wall passage 142, thus biasing the rail 132 upward to be stored while not in use. In some examples the weight 162 may form a portion of the lever 222 and both bias the rail 132, as well as control the height of the grate 210.

FIG. 6B illustrates a side view of the side wall passage 142 with the rail 132 in the active position. In the active position with a rack 112 arranged on the rail 132, the rail 132 is weighted down in the active position. This forces the weight 162 within the wall passage 142 to elevate the grate 210 at the lip end 222. Thus, in the rest position the weight 162 biases the rail 132 upwards and lowers within the passage 142, which subsequently allows the grate which rests on the weight 162 to lower as well. Then, upon installation of a rack, the rail 132 moves into the active position, overcoming the weight's biasing affect and elevating the grate 210 so that the openings and air passages align.

As explained, the weight 162 may form the lever 220. In this example, the lever 220 may extend out of the side wall at an opening and align with the angle of the rail 132. The lever 220 may be configured to move with the rail 132 as the rail moves between rest and active positions. The lip end 222 illustrated in FIGS. 6A and 6B illustrate differ slightly from the examples shown in FIGS. 3A and 3B, and 4A and 4B in that the end 222 forms more of a right angle with respect to the grate 210.

Figure 7:
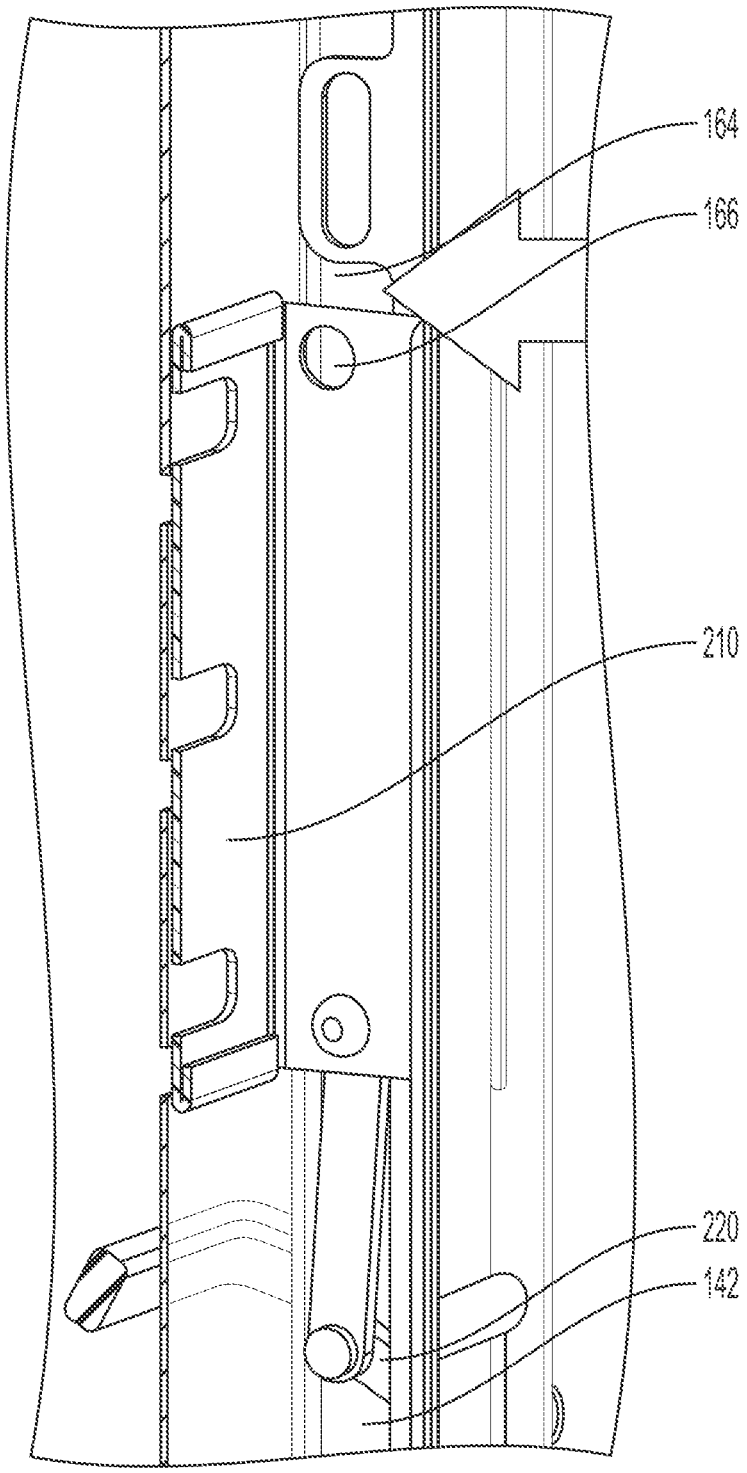
FIG. 7 illustrates another side view of the side wall passage.

FIG. 7 illustrates another side view of the side wall passage 142 including a biasing member 164 including a spring. The biasing member 164 may be attached at the grate support 230 via a spring opening 166. The lever 220 may pivotally attach to a support rod 165 that extends between the grate support 230 and the lever 220. The support rod 165 may be pivotally attached at the grate support 230 and may move vertically upon actuation of the lever 220. Thus, when the lever 220 is in the rest position, as illustrated in FIG. 7, the lever is lowered within the passage 142 and thus the grate 210 is lowered, misaligning the openings and passages. When the rail 132 is pulled down by a rack, the lever 220 is also actuated, elevating the support rod 165 and also the grate 210. The biasing member 164 maintains the grate 210 at its natural "closed" and lowered position when the rail 132 is in the rest position, but also allows the grate 210 to be elevated in the active position while maintaining the relative placement within the passage 142.

Accordingly, a cooking system that activates air passages only where the oven rack is installed is disclosed. This system improves the cooking performance in the terms of cooking times in that convection air is pushed to only the needed levels, keeping other air passages closed to direct more heat to the necessary racks. The system provides for a user friendly and easy to use rack system with minimal components. The alignment and misalignment of the air passages are facilitated by a lever arrangement attached to the rails. The simple, yet sturdy, arrangement between the grate and side walls allows for an efficient cost effective way to target air flow within the cabinet.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

The flowcharts and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. A cooking appliance, comprising:

an oven cavity having a cavity top, a cavity back, and cavity side walls, an interior side wall extending parallel to each of the cavity side walls defining a passage therebetween, a plurality of side rails extending along the interior side walls, the plurality of side rails being rotatable between a rest position in which no oven rack is installed and airflow to the oven cavity is blocked, and an active position in which the oven rack is installed and airflow to the oven cavity is provided, a lever is fixed to at least one of the plurality of side rails and configured to be actuated upon rotation of the at least one of the plurality of side rails, and an air grate associated with the at least one of the plurality of side rails and arranged within the passage between the interior side wall and at least one of the cavity side walls, wherein the air grate defines at least one grate opening, and configured to rest on the lever where the air grate is movable with the lever between a first position when the at least one of the plurality of side rails is in the rest position, and a second position when the at least one of the plurality of side rails is in the active position.

2. The cooking appliance of claim 1, wherein the interior side wall defines at least one wall opening, the at least one grate opening being configured to align with the at least one wall opening when the air grate is in the active position to allow heated air to pass from the passage to the oven cavity, and to cover the at least one wall opening when the air grate is in the rest position to restrict heated air from passing through to the oven cavity, thus increasing heated air flow to the oven rack that is in use.

3. The cooking appliance of claim 2, wherein the air grate includes an end projection configured to engage with the at least one of the cavity side walls to maintain the air grate relative to the at least one of the cavity side walls.

4. The cooking appliance of claim 3, wherein the cavity side walls define at least one slot configured to receive the end projection of the air grate and allow vertical movement of the end projection.

5. The cooking appliance of claim 1, wherein the lever is in communication with the air grate and configured to vertically move the air grate upon actuation thereof, where the air grate is lowered in response to the at least one of the plurality of side rails being in the active position and elevated when the at least one of the plurality of side rails is in the rest position.

6. The cooking appliance of claim 1, wherein the at least one of the plurality of side rails include a top support and a bottom support forming a C-like shape to receive one end of the oven rack.

7. A convection oven having variable air flow patterns depending on oven rack placement therein, comprising:

an oven cavity having a cavity top, a cavity back, and cavity side walls, a plurality of side rails extending along the cavity side walls, the plurality of side rails being movable between a rest position in which no oven rack is installed and airflow is blocked, and an active position in which the oven rack is installed and airflow is provided, wherein each of the cavity side walls define a set of air passages corresponding to each of the plurality of side rails and configured to provide convection air to the oven rack arranged on one of the plurality of side rails, and an air grate associated with at least one of the plurality of side rails and arranged within a passage defined within the cavity side walls, wherein the air grate defines a plurality of grate openings and is movable with the at least one of the plurality of side rails between a first position when the at least one of the plurality of side rails is in the rest position, and a second position when the at least one of the plurality of side rails is in the active position.

8. The convection oven of claim 7, wherein the plurality of grate openings are configured to align with the set of air passages when the air grate is in the active position to allow convection air to pass from the passage to the oven cavity, and wherein the air grate is configured to cover wall openings when the air grate is in the rest position to restrict convection air from passing through to the oven cavity, thus increasing convection air flow to the oven rack that is in use.

9. The convection oven of claim 8, wherein the air grate includes an end projection configured to engage with at least one of the cavity side walls to maintain the air grate relative to the at least one of the cavity side walls.

10. The convection oven of claim 9, wherein the at least one of the cavity side walls defines at least one slot configured to receive the end projection of the air grate and allow vertical movement of the end projection.

11. The convection oven of claim 7, further comprising at least one lever in communication with the at least one of the plurality of side rails and configured to actuate with the at least one of the plurality of side rails.

12. The convection oven of claim 11, wherein the at least one lever is in communication with the air grate and configured to vertically move the air grate upon actuation thereof, where the air grate is lowered in response to the at least one of the plurality of side rails being in the active position and elevated in response to the at least one of the plurality of side rails being in the rest position.

13. The convection oven of claim 11, wherein the at least one lever includes a weight arranged within the passage to bias the at least one of the plurality of side rails in the rest position.

14. The convection oven of claim 13, wherein the air grate includes an end lip configured to rest on the weight such that the air grate moves vertically upon actuation of the at least one lever.

15. The convection oven of claim 7, wherein the at least one of the plurality of side rails include a top support and a bottom support forming a C-like shape to receive one end of the oven rack.

16. A cooking appliance, comprising:

an oven cavity having a cavity top, a cavity back, and cavity side walls, an interior side wall extending parallel to each of the cavity side walls defining a passage therebetween, a plurality of side rails extending along the interior side walls, the plurality of side rails being rotatable between a rest position in which no oven rack is installed and airflow is blocked, and an active position in which the oven rack is installed and airflow is provided, a lever is fixed to at least one of the plurality of side rails and configured to be actuated upon rotation of the at least one of the plurality of side rails, wherein the lever is in communication with an air grate and configured to vertically move the air grate upon actuation thereof, where the air grate is lowered in response to the at least one of the plurality of side rails being in the active position and elevated when the at least one of the plurality of side rails is in the rest position.

* * * * *